US011919068B2

(12) United States Patent
De Vincenti et al.

(10) Patent No.: US 11,919,068 B2
(45) Date of Patent: Mar. 5, 2024

(54) CORE FOR CASTINGS

(71) Applicant: HITEC S.R.L., Cesena (IT)

(72) Inventors: Serafino De Vincenti, Bologna (IT); Giampaolo Campana, Bologna (IT)

(73) Assignee: HITEC S.R.L., Cesena (IT)

( * ) Notice: Subject to any disclaimer, the term of this patent is extended or adjusted under 35 U.S.C. 154(b) by 0 days.

(21) Appl. No.: 17/287,755

(22) PCT Filed: Oct. 23, 2019

(86) PCT No.: PCT/IB2019/059039

§ 371 (c)(1),
(2) Date: Apr. 22, 2021

(87) PCT Pub. No.: WO2020/084499

PCT Pub. Date: Apr. 30, 2020

(65) Prior Publication Data

US 2021/0394258 A1 Dec. 23, 2021

(30) Foreign Application Priority Data

Oct. 23, 2018 (IT) ..... 102018000009724

(51) Int. Cl.

| | |
|---|---|
| ***B22C 9/10*** | (2006.01) |
| ***B22C 1/00*** | (2006.01) |
| ***B22C 9/06*** | (2006.01) |
| ***B22C 9/24*** | (2006.01) |

(52) U.S. Cl.
CPC ..... *B22C 9/24* (2013.01); *B22C 1/00* (2013.01); *B22C 9/065* (2013.01); *B22C 9/10* (2013.01)

(58) Field of Classification Search
CPC .. B22C 1/00; B22C 9/06; B22C 9/065; B22C 9/10; B22C 9/108; B22C 9/24; B22D 19/00; B22D 19/0072
USPC ..... 164/159, 369
See application file for complete search history.

(56) References Cited

U.S. PATENT DOCUMENTS

| | | | |
|---|---|---|---|
| 4,905,750 | A | 3/1990 | Wolf |
| 2017/0074205 | A1 | 3/2017 | Maki et al. |

FOREIGN PATENT DOCUMENTS

| | | | |
|---|---|---|---|
| DE | 102011076312 | A1 | 11/2012 |
| GB | 907410 | A | 10/1962 |
| GB | 1209382 | A | 10/1970 |

*Primary Examiner* — Kevin P Kerns
(74) *Attorney, Agent, or Firm* — Leason Ellis LLP

(57) ABSTRACT

A core (1) for producing castings (100) in a modular mold; each casting (100) having at least one thermally activatable portion (102) shaped so that it can face a heat source (HS); each casting (100) having at least one duct (106) contained inside the portion (102); the duct (106) being fluid tight so that a fluid can flow through it; the core (1) having a suitable shape to form, in negative, the duct (106); the core (1) including at least one insert (20)(20')(20") shaped so as to define at least two passages (200)(200') for the fluid inside the duct (106).

17 Claims, 2 Drawing Sheets

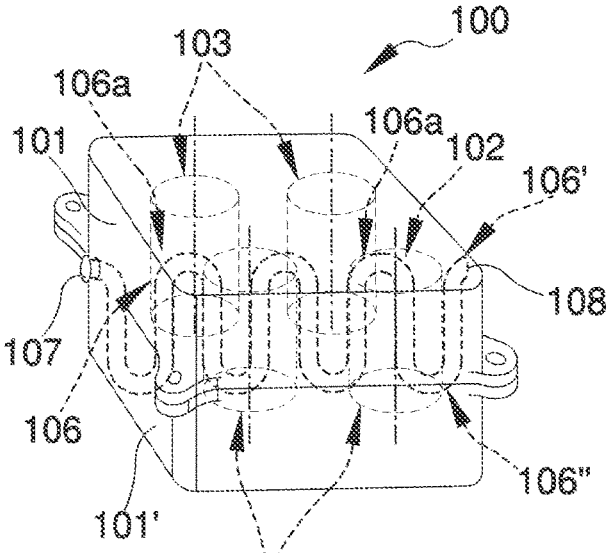
Fig.1
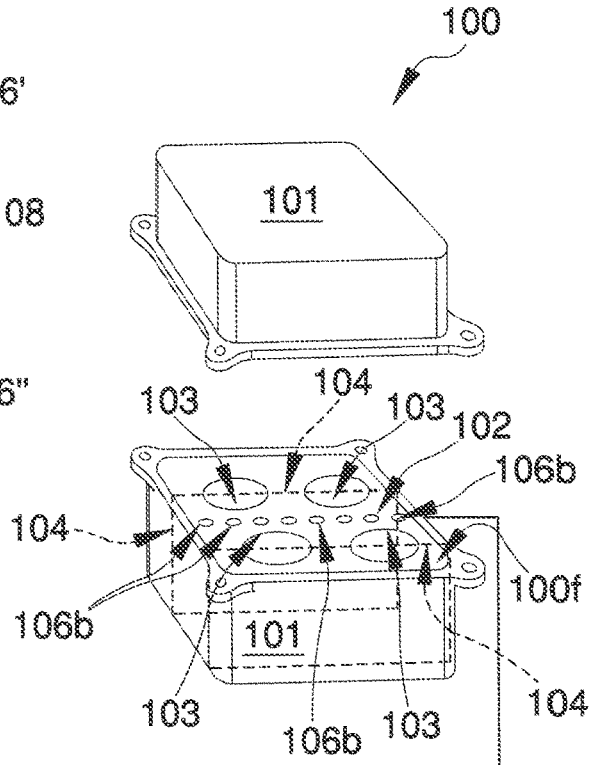
Fig.2
Fig.3a
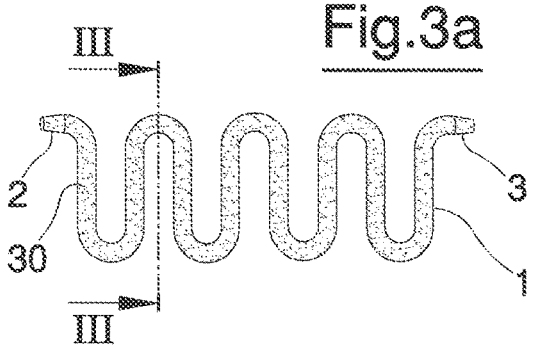
Fig.3b
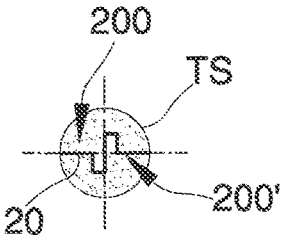
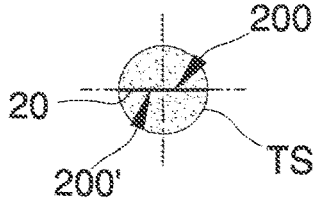
Fig.3c
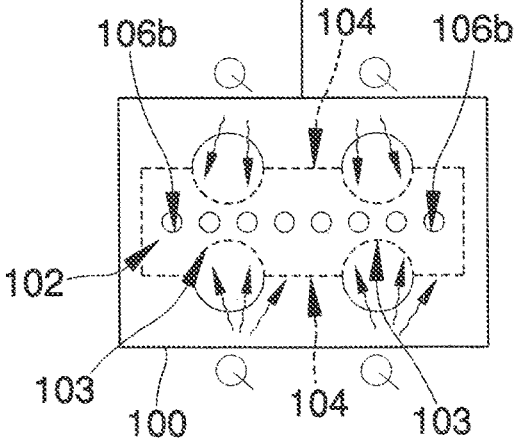
Fig.2a

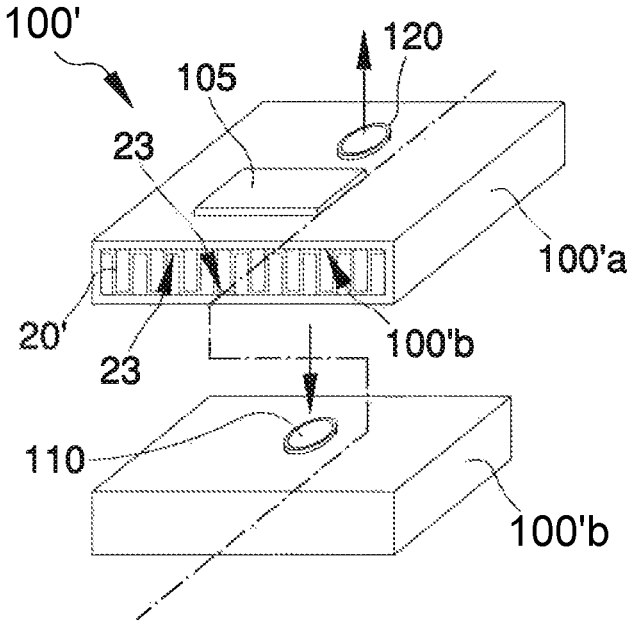
Fig.4
Fig.5
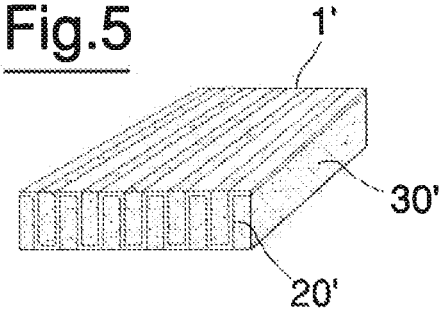
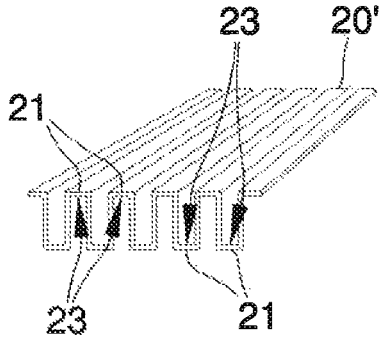
Fig.6
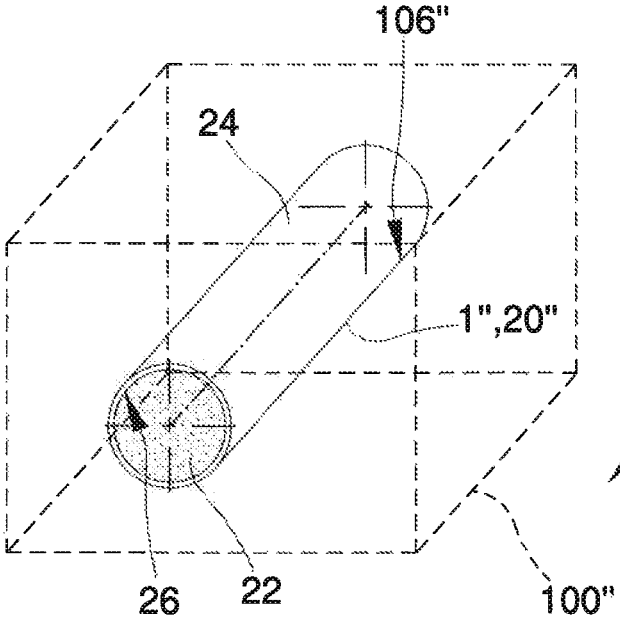
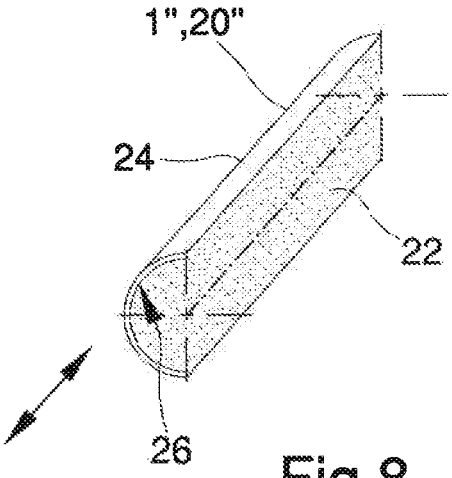
Fig.8
Fig.7

CORE FOR CASTINGS

The present invention concerns a casting that can be produced in a modular mold. In particular, the present invention refers to a casting that can be produced using a modular mold and having at least one portion designed to exchange heat. In greater detail, the present invention refers to a casting that can be produced using a modular mold and having at least one portion designed to exchange heat, where said portion is delimited by an external wall designed to face a heat source and has at least one fluid tight duct so that a cooling fluid can flow through it.

DESCRIPTION OF THE STATE OF THE ART

It is known that every device that produces or transmits mechanical work or which operates when electrically powered is associated with an optimal operating temperature, which can be higher or lower than the ambient temperature. In some cases, the maintenance of said optimal temperature is necessary to guarantee the correct operation of the device. In the automotive sector, in data management and exchange systems, lighting, and in particular, industrial power lasers, electric motors, internal combustion and hybrid engines, electric motors, inverters, converters, and in many other devices in which the heat produced during operation would cause failure of the device if not removed, the need to rapidly dissipate quantities of heat produced inside portions of said devices, called hot bodies, for the sake of practicality, is known. Said term identifies, here and below, heat dissipators, exchangers and accumulators, without limiting the generality of the present description. Summarily, within said bodies there may be parts in relative movement such as, for example, but not limited to, electronic devices or boards. In order to maintain the internal temperature at given levels, the removal of said quantities of heat is facilitated if said hot bodies are provided with fins designed to increase the extension of the surfaces in contact with the heat sources to dissipate it in a fluid, normally free or appropriately forced air.

When a significant amount of heat is produced in the unit of time inside the hot bodies, to avoid mechanical seizure between moving parts or localized fusion of portions of hot bodies, channels are obtained leaving "interspaces" between the latter and the heat source, namely portions of material having mechanical characteristics such as not to condition the functionality of the device of which the hot bodies form a part.

However, the production of devices with increasingly miniaturized dimensions capable of increasingly high-level performances is accompanied by a greater concentration of heat that has to be disposed of, concentrated in increasingly small areas of the respective hot bodies. Electronic components, in which miniaturization corresponds to a reduction in the component masses, and therefore also in the extension of the cooling surfaces, are a classic example of this need, which does not limit the scope of the present discussion.

Due to their complex form, the current hot bodies, operating indifferently as dissipators, heat exchangers or heat accumulators, are currently produced by assembling copper or aluminum sheets, extruded semi-finished products, or semi-finished products with complex geometries produced by chip removal. The assembly phase can be carried out by means of traditional or innovative joining techniques (for example Gas Metal Arc Welding (GMAW) or LASER, etc.), hard or soft soldering, Diffusion Bonding (DB), Friction Stir Welding (FSW), or by means of hybrid joining techniques, or by combining seals and threaded members.

It is evident that the reduction in the number of semi finished or elementary components that make up the base of the hot bodies would simplify and significantly reduce the cost of the relative manufacturing cycle, with maximum cost effectiveness obviously being achieved if said bodies could be produced with fusion type technologies, therefore as castings produced preferably in modular molds using cores conceived and designed for mass production.

In relation to the above, the problem of producing hot bodies as castings in modular molds and using cores is currently unsolved, and represents an interesting challenge for the applicant.

In view of the situation described above it would be desirable to have equipment for the casting process that could be used to produce hot bodies which, in addition to limiting and if possible overcoming the drawbacks typical of the above illustrated state of the art, allowed for the application of new, more rapid and less costly operating modes to produce the so-called hot bodies.

SUMMARY OF THE PRESENT INVENTION

The present invention concerns a core for a casting that can be produced by using a modular mold and a relative casting that can be produced by using a modular mold. In particular, the present invention refers to a casting that can be produced by using a modular mold and having at least one portion designed to exchange heat. More in detail, the present invention refers to a casting that can be produced using a modular mold and having at least one portion designed to exchange heat, where said portion is delimited by an outer wall designed to face a heat source and has at least one fluid tight duct which a fluid can flow through.

The above problems are solved by the present invention according to at least one of the following claims.

According to some embodiments of the present invention, a core is made for producing a casting in a modular mold; said casting having at least one thermally activatable portion and delimited by a surface shaped so that it can face a heat source; said casting having at least one duct contained inside said portion on the side of said surface; said duct being fluid tight so that a fluid can flow through it; said core having a suitable shape, in particular tubular, to form said duct in negative; said core comprising at least one insert shaped to define at least two passages for said fluid inside it and therefore within said duct.

In some embodiments of the present invention, said insert is incorporated in a shaped body made of refractory material and sized for shape fitting at least a part of said core. In some cases, said insert has a prismatic shape and open cross-section.

If deemed useful, said cross-section has an extension that exceeds a maximum characteristic dimension of said core.

According to a possible construction variation of the present invention, said insert has a closed cross-section. In some cases, said insert contains channeling means for said fluid.

If deemed useful, said channeling means comprise an elongated body made of material having an open cell reticulated structure and shaped so that a fluid can flow through it.

Said insert can be produced in a material with thermal conductivity ranging from $10^2$ to $10^4$ W/m K. In particular, said given material can comprise a metal selected from aluminum and/or relative alloys, copper and/or relative alloys, gold and/or relative alloys, silver and/or relative alloys.

If deemed useful, said given material can comprise graphene.

According to other embodiments of the present invention, a casting is provided that can be produced using a modular mold; said casting having at least one thermally activatable portion delimited by a surface shaped so that it can face a heat source; said casting having at least one duct contained inside said portion dose to said surface; said duct being fluid tight so that a fluid can flow through it; at least one insert being contained inside said duct to define at least two passages for said thermal fluid.

In some embodiments of the present invention, said insert is incorporated in a shaped body made of a refractory material and sized for longitudinally shape fitting said duct.

In some cases, said insert has a prismatic shape and open cross-section.

In particular, said insert can have an open cross-section with extension exceeding a maximum dimension characteristic of said duct.

In other cases, said insert has a closed cross-section.

If deemed useful, said insert contains channeling means for said fluid.

In particular, said channeling means comprise an elongated body made of material having an open cell reticular structure and shaped so that a fluid can flow through it.

In some embodiments of the present invention, said insert is made of a given material, having thermal conductivity ranging from $10^2$ to $10^4$ W/m K.

If deemed useful, said given material comprises a metal selected from aluminum and/or relative alloys, copper and/or relative alloys, gold and/or relative alloys, silver and/or relative alloys.

In some cases, said given material comprises graphene.

BRIEF DESCRIPTION OF THE FIGURES

Further characteristics and advantages of the casting with heat exchanger and a core that can be used in the relative casting process according to the present invention will become clearer from the following description, with reference to the attached figures that illustrate some non limiting embodiment examples thereof, in which identical or corresponding parts are identified by the same reference numbers. In particular:

FIG. 1 is a schematic perspective view, with internal parts represented by broken lines, of a first preferred embodiment of a casting made in two blocks and produced in a modular mold using a first core according to the present invention;

FIG. 2 is an exploded view of FIG. 1 with parts hidden for the sake of clarity;

FIG. 2*a*) schematically illustrates one of the functions of a portion of FIG. 2;

FIG. 3*a*) is a schematic perspective view of a first preferred embodiment of a core according to the present invention;

FIGS. 3*b*) and 3*c*) show cross-sectional views according to the line III-III of FIG. 3*a* of two preferred embodiments of a core according to the present invention;

FIG. 4 is a schematic perspective view of a second preferred embodiment of a casting that can be produced by using a second core according to the present invention;

FIG. 5 is a schematic perspective view of a second preferred embodiment of a core according to the present invention;

FIG. 6 is a schematic perspective view of an insert extracted from FIG. 5;

FIG. 7 is a schematic perspective view of a third preferred embodiment of a core according to the present invention; and FIG. 8 is a diametral longitudinal section of a portion of FIG. 7.

DETAILED DISCLOSURE OF THE PRESENT INVENTION

In FIG. 1, a casting 100 can be produced using a modular mold of known type and not illustrated for the sake of economy of drawing. The casting 100 can be seen in FIG. 2, where it is split into the two component blocks 101 and 101', each of which is produced in a half-mold, known and not illustrated. Each block 101/101' is delimited by a face 100*f*, visible only in FIG. 2 with reference to the lower block 101' for the sake of economy of drawing.

It is useful to specify that the shape of the casting 100 has been designed for the sole purpose of simplifying the description of at least one embodiment of the present invention and should not be interpreted as an example of a particular casting intended for a given use. However, considering the above premises, and the fact that the invention has a particularly important application in the automotive sector, the casting 100 in question has been given shapes that recall the geometry of a block of a simplified internal combustion engine or, better yet, of a part thereof. With this in mind, the casting 100 comprises a plurality of cylindrical hollow portions 103 which are arranged at the vertexes of a quadrilateral to reproduce the cylinders inside which the pistons of an internal combustion engine transform in mechanical work the thermal energy that accompanies the chemical reactions between fuel and combustion. Again with reference to FIG. 1, the casting 100 has at least one duct 106 for a technical fluid, therefore positioned between the hollow portions 103, without limiting the scope of the present invention. For practical reasons, said duct 106 is shaped similar to a coil which crosses the two blocks 101 and 101', each with a respective part 106' and 106" which comprises at least one arc-shaped portion 106*a*. As shown in FIG. 1, each arc 106*a* is delimited by respective circular openings 106*b* which open in the face or surface 100' of the respective block 101/101'. For practical reasons, indications on the solutions adopted to render fluid tight the connections of the two parts 106' and 106" between the openings 106*b* of the duct 106 are omitted for reasons of economy of text and drawings, since they are not relevant to the subject of the invention. The duct 106 is fluid tight so that a fluid can flow through it between the respective inlet and outlet openings 107 and 108, shown only in FIG. 1.

To obtain the duct 106 by melting process inside the casting 100 it is necessary to use a core 1, the shape of which is in negative to that of the duct 106. Naturally, said core 1 at its respective ends has conical portions 2 and 3 necessary for the respective arrangement in the mold to be used for the melting process. For practical reasons, the shape of the core 1 is not illustrated in further detail, focusing only on the aspects concerning the subject of the invention. In particular, with reference to FIG. 3*a*), the core 1 is shaped as a coil arranged to entirely determine the duct 106. Furthermore, the core 1 comprises a body 30 with cylindrical cross-section and made of refractory material. Said body 30 incorporates an insert 20 (shown only in FIGS. 3*b* and 3*c*), which is sized to shape fit at least a part of the duct 106 at the end of the melting process, which is assumed to be known. Each insert 20 is shaped to define at least two passages 200/200' (channels) for the fluid inside the duct 106. The decision to arrange said duct 106 in the casting 100 in said position (visible in FIGS. 1 and 2) is coherent with the formal analogy described above with a simplified combustion engine block or, better yet, a part thereof. In this way, between the hollow portions 103 it is possible to identify a central portion 102 delimited by one of the two ideal surfaces 104, interfaceable with at least one heat source which, according to the analogy described above, in this example are symmetrical and comprise a part of each hollow portion 103. In relation to the above description, it can be said that portion 102 is central considering its spatial arrangement in the casting 100 and that it is thermally activatable if considered in functional terms.

The traces of said surfaces 104 can be seen in FIG. 2, shown as a broken line in FIG. 2*a*, where the heat Q exchanged through the surfaces 104 is schematized with the letters Q.

In relation to the above description, the insert 20 has a prismatic shape and open cross-section TS. In the embodiment of FIGS. 3*b*) and 3*c*) the insert 20 is obtained by using a flat or bent sheet metal body to highlight some steps. Therefore, in the case shown in FIG. 3*b*) (top figure) the transverse extension of the insert 20, namely the sum of the lengths of the rectilinear parts (in cross-section) exceeds a maximum characteristic dimension (essentially the diameter) of the body made of refractory material (30), and therefore of the duct 106 (see the following description), connecting two diametrically opposite points of the section with a part having the two rectangular steps.

According to one embodiment, the prismatic shape of the insert 20 should be understood in the sense that all the cross-sections of the core 1, of the body made of refractory material 30, are shaped similarly to those illustrated in FIGS. 3*b*) and 3*c*); consequently also all the cross-sections of the duct 106, where the presence of the insert 20 determines the definition of the independent passages 200/200', are identical. The passages 200/200' can therefore have sections with different shapes, defined by the cross-section of the insert 20 based on design criteria relative to the thermodynamics of the duct 106. In fact, it can be easily seen that each passage 200/200' is delimited by a portion of the duct 106 and by a face of the insert 20. Naturally, each FIGS. 3*b*) and 3*c*) shows possible versions thereof, through which two fluids can flow in counter-current.

According to one embodiment, the body made of refractory material 30, 30' and the insert 20 are housed in a tubular element 500, for example made of metallic material, where in this case the transverse extension of the insert 20, namely the sum of the lengths of the rectilinear parts (in cross-section) exceeds a maximum characteristic dimension (essentially the diameter) of the body made of refractory material (30) and therefore shape- and size-fits the tubular element 500.

The use of the core 1 to produce the casting 100 can be easily understood by a person skilled in the art and would not require any further explanation. Nevertheless, a description is provided below of the main phases of the methods of use of the plate and therefore of the process for formation of the casting 100.

In the case of the embodiment without the tubular element 500, the core 1, including the body made of refractory material 30 and the insert 20, is positioned in a mold (not shown), where the subsequent phases entail the inlet of molten material into the mold and the subsequent cooling thereof. The cooled block is then divided into the two blocks 101 and 101', where during the subsequent phase the refractory material of the body 30 is removed, thus obtaining the duct 106 engaged internally by the insert 20 which defines the two passages 200 and 200' for the passage of two fluids in counter-current.

This effectively overcomes a problem typical of the castings of the known art, in which cooling ducts with one passage do not enable an effective cooling since the cooling fluid introduced through one (inlet) end of the duct reaches excessively high temperatures prior to nearing the opposite (outlet) end of the duct 106, hence the cooling is often insufficient at least at the outlet end of the duct 106. On the other hand, the inlet of fluid in counter-current into the two passages 200 and 200' of the duct 106 provided with the core 1 according to the present invention guarantees an adequate and satisfactory cooling of the entire casting 100.

In the case of the embodiment inclusive of the tubular element 500, the methods of use of the core 1 and therefore the phases of formation of the casting 100 correspond partly to those summarized previously. Also in this case, in fact, the core 1, inclusive of the body made of refractory material 30 and the insert 20, is positioned in a mold (not shown), where the subsequent phases entail the inlet of molten material into the mold and the subsequent cooling thereof. The cooled block is then divided into the two blocks 101 and 101', where during the subsequent phase the refractory material of the body 30 is removed from the tubular element 500, thus obtaining the duct 106 defined by the same tubular element 500 engaged internally by the insert 20 which therefore defines, also in this case, the two passages 200 and 200' for the passage of two fluids in counter-current. Furthermore, it may be useful to specify that, in order to promote the thermal exchange between the fluid that engages the duct 106 and the blocks 101 and 101' that compose the casting 100, the insert 20 can be produced in a material with particularly high thermal conductivity. This allows maximum removal of heat both by means of the longitudinal ends of the insert 20, and with the fluid or fluids that crosses/cross the duct 106 in one or in two directions.

Preferably, but without limitation, the thermal conductivity of the material of the insert 20 ranges from $10^2$ to $10^4$ W/m K. Therefore, the given material can comprise a metal chosen from aluminum and/or relative alloys, copper and/or relative alloys, gold and/or relative alloys, silver and/or relative alloys, or also can be produced wholly or partly in graphene.

The choice of materials that have said characteristic combines with the capacity of the fluid carried by the insert 20 to remove/transport heat, given that the same insert 20 performs the function of thermal bridge between two sides of the casting 100 that incorporates it.

Lastly, it is clear that modifications and variations can be made to the core 1 described and illustrated here without departing from the scope of the present invention.

For example, the casting 100 can have a different shape, such as the parallelepipedal shape of the casting 100' shown in FIG. 4, where it is shown sectioned longitudinally into two parts 100' a and 100'*b* in an intermediate position between the respective inlet opening 110 and outlet opening 120 to generate a duct 106 having rectangular section. It may be useful to specify that the two parts 100' a and 100'*b* of the casting 100' generated are shown overlapped rather than aligned in FIG. 4, exclusively for reasons of practicality and economy of drawing. The casting 100' furthermore has a plate 105 which has the purpose of physically representing an area of thermal exchange concentrated between the casting 100' and the outside, which actuates the thermally activatable portion 102 of the casting 100. In particular, the core 1 of FIG. 3*a*) is modified in the core 1' of FIG. 5 and contains the insert 20' of FIG. 6, incorporated in a parallelepipedal body 30' made of refractory material. The insert 20' comprises a plurality of square teeth 21 which, in the casting 100', determine a plurality of channels 23 having rectangular section, each one designed to exchange heat longitudinally and transversally.

With reference to FIGS. 7 and 8, a core 1" comprises an insert 20" having a different shape, given that the respective cross-section is dosed. In particular, said insert 20" is delimited by a wall 24 which internally delimits an own duct 26. Said wall 24 is shown with cylindrical shape in FIGS. 7 and 8, without limiting the scope of the present invention. Said insert 20" is designed to permanently engage a longitudinal duct 106" obtained by the insert 20" in the casting 100" to be produced, illustrated here in simplified form and with broken line for reasons of economy of drawing. In particular, in use, the insert 20" is designed to convey technical liquid into its duct 26 and, as described and illustrated, also into the duct 106", with which it substantially shares shape and dimension. In fact, the wall 24 of the insert 20" has the sole purpose of avoiding intrusion of the liquefied metal during the melting process and, as described above, also into its own duct 26 which substantially coincides with the duct 106" obtained in the casting 100". In addition, to maximize the thermal exchange through the wall of the casting 100" which embraces the cylindrical insert 20", the latter, and naturally the core 1" that totally comprises it, has channeling members 22 for the fluid, which can be produced using material having an open cell reticulated structure and shaped so that a fluid can flow through it. An example of said material is shown schematically in FIGS. 7 and 8. Also in said case, alongside the capacity of the fluid carried by the insert 20" there is the "linear" dissipation capacity of the insert itself, which acts as a thermal bridge between two sides of the casting that incorporates it.

In relation to the above description, it may be useful to specify that due to the presence of a continuous outer skin consisting of the wall 24, and the fact that said wall 24 adheres to the surface that internally delimits the duct 106" obtained in the casting 100", it is not necessary to provide the insert 20" with parts made of refractory sand, possibly having the purpose of conditioning the path of the molten metal inside the mold (not illustrated) necessary for producing the casting 100", also because any use of sand would inevitably determine non-adhesion of the insert 20" to the wall that internally delimits the corresponding duct 106".

From the above description, it is easy to see that the scope of the present invention is decidedly widespread, since it extends the use of foundry production technologies to multiple fields of application in which heat sources at high temperature require the mediation of technical fluids; this reduces the cost of producing servers and mainframes for data management and exchange, lighting equipment, industrial power lasers, electric motors, internal combustion and hybrid engines, electric motors, inverters, converters and all other devices in which the heat produced during operation rapidly causes failure of the device if not removed using a technical fluid.

The above also applies to cases in which the heat has to be transmitted to the casting 100, 100' or any other form through inserts of the type 20, 20' or 20".

The invention claimed is:

1. A core for producing castings in a modular mold; each of said castings having at least one thermally activatable portion shaped so that it is configured to face a heat source; each of said castings having at least one duct contained inside said at least one portion; said at least one duct being fluid tight so that a fluid is configured to flow through it; said core having a shape to form, in negative, said at least one duct; said core comprising:

a shaped body made of refractory material; and at least one insert incorporated in said shaped body and configured to define at least two passages for said fluid inside said at least one duct;

wherein the at least one insert comprises a physical structure that partitions the shaped body into a first section and a second section that is completely separated and spaced from the first section.

2. The core according to claim 1, wherein said at least one insert is sized to shape-fit at least a part of said at least one duct.

3. The core according to claim 1, wherein said shaped body is housed in a tubular element, and in that said at least one insert is sized to internally shape-fit at least one part of said tubular element.

4. The core according to claim 1, wherein said at least one insert has a prismatic shape and open cross-section.

5. The core according to claim 4, wherein said cross-section has an extension that exceeds a maximum characteristic dimension of said at least one duct and a tubular element.

6. The core according to claim 1, wherein said at least one insert has a closed cross-section, each of said passages defining a portion of a fluid path configured to receive said fluid.

7. The core according to claim 1, wherein said at least one insert contains channeling means for said fluid.

8. The core according to claim 7, wherein said channeling means comprise an elongated body made of a material having an open cell reticulated structure and shaped for a fluid to pass through it.

9. The core according to claim 1, wherein said at least one insert is made of a material with thermal conductivity ranging from 102 to 104 W/m K.

10. The core according to claim 9, wherein said material comprises a metal selected from aluminum and/or relative alloys, copper and/or relative alloys, gold and/or relative alloys, silver and/or relative alloys.

11. The core according to claim 9, wherein said material comprises graphene.

12. The core according to claim 1, wherein the shaped body and the at least one insert have a serpentine shape.

13. The core according to claim 1, wherein the at least one insert extends across an entire width of the shaped body.

14. The core according to claim 1, wherein the at least one insert includes first and second planar surfaces, the first planar surface facing the first section of the shaped body and the second planar surface facing the second section of the shaped body.

15. The core according to claim 1, wherein the shaped body has a cylindrical shape and the at least one insert extends across a complete diameter thereof.

16. The core according to claim 1, wherein the first and second sections have rectangular shapes.

17. A core assembly for producing castings in a modular mold; each of said castings having at least one thermally activatable portion shaped so that it is configured to face a heat source; each of said castings having at least one duct contained inside said at least one portion; said at least one duct being fluid tight so that a fluid is configured to flow through it; said core assembly having a shape to form, in negative, said at least one duct; said core assembly comprising:

an inner core having:

a shaped body made of refractory material; and at least one insert incorporated in said shaped body and configured to define at least two passages for said fluid inside said at least one duct; and a tubular element that surrounds the inner core;

wherein the at least one insert comprises a physical structure that partitions the shaped body into a first section and a second section that is separated from the first section, the at least one insert extending to the tubular element.

* * * * *